US011730322B1

(12) United States Patent
Aburime

(10) Patent No.: US 11,730,322 B1
(45) Date of Patent: Aug. 22, 2023

(54) NECK-WORN HAND SANITIZER DISPENSER

(71) Applicant: Francis Aburime, Bowie, MD (US)

(72) Inventor: Francis Aburime, Bowie, MD (US)

( * ) Notice: Subject to any disclaimer, the term of this patent is extended or adjusted under 35 U.S.C. 154(b) by 211 days.

(21) Appl. No.: 17/189,378

(22) Filed: Mar. 2, 2021

(51) Int. Cl.
*A47K 5/12* (2006.01)
*A44C 15/00* (2006.01)

(52) U.S. Cl.
CPC ..... *A47K 5/1201* (2013.01); *A44C 15/002* (2013.01); *A44C 15/005* (2013.01)

(58) Field of Classification Search
CPC ..... B05B 7/1413; B67D 2210/00131; A47K 5/1201; A47K 5/1217; A61L 2/00; A44C 15/002; A44C 15/005; A45F 3/02; A45F 2003/002
See application file for complete search history.

(56) References Cited

U.S. PATENT DOCUMENTS

| | | | | |
|---|---|---|---|---|
| 3,434,628 | A * | 3/1969 | Ceraldi | A47K 5/10 222/52 |
| 4,967,935 | A * | 11/1990 | Celest | A47K 5/1217 222/642 |
| 5,695,091 | A | 12/1997 | Winings | |
| 6,394,987 | B1 | 5/2002 | Sandlin | |
| 7,988,020 | B2 | 8/2011 | Shoham | |
| 8,237,558 | B2 * | 8/2012 | Seyed Momen | G08B 21/245 340/286.07 |
| 9,957,125 | B2 * | 5/2018 | Ray | A61B 50/20 |
| 10,042,984 | B2 | 8/2018 | Zaima | |
| 10,219,656 | B2 * | 3/2019 | Pelfrey | A47K 5/1217 |
| 10,264,859 | B2 | 4/2019 | Parker | |
| 11,304,570 | B1 * | 4/2022 | Shaukat | A47K 5/1217 |
| 2006/0186140 | A1 | 8/2006 | Kanfer | |

FOREIGN PATENT DOCUMENTS

| | | |
|---|---|---|
| WO | 2015085322 | 6/2015 |
| WO | WO-2021231295 A1 * | 11/2021 |

OTHER PUBLICATIONS

Life+Guard Wearable Sanitizer Dispenser 2020; obtained on Apr. 20, 2023 from: https://www.youtube.com/watch?v=bb6q-29Obzw.*
Life+Guard intro; obtained on Apr. 20, 2023 from:https://www.youtube.com/watch?v=rTvtukaRY4Q&t=16s.*

* cited by examiner

*Primary Examiner* — Paul R Durand
*Assistant Examiner* — Randall A Gruby
(74) *Attorney, Agent, or Firm* — Kyle A. Fletcher, Esq.

(57) ABSTRACT

The neck-worn hand sanitizer dispenser comprises a sanitizer vessel, a dispensing mechanism, and a neck strap. The neck-worn hand sanitizer dispenser may be adapted to be worn around a neck of a user via the neck strap such that the sanitizer vessel hangs in front of a chest of the user. The neck-worn hand sanitizer dispenser may be adapted to dispense a sanitizer liquid onto a hand of the user when the user triggers the dispensing mechanism by placing the hand beneath the sanitizer vessel. The dispensing mechanism may be disabled via a lock control to prevent dispensing the sanitizer liquid accidently.

8 Claims, 4 Drawing Sheets

NECK-WORN HAND SANITIZER DISPENSER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of personal hygiene and sanitization systems, more specifically, a neck-worn hand sanitizer dispenser.

Summary of Invention

The neck-worn hand sanitizer dispenser comprises a sanitizer vessel, a dispensing mechanism, and a neck strap. The neck-worn hand sanitizer dispenser may be adapted to be worn around a neck of a user via the neck strap such that the sanitizer vessel hangs in front of a chest of the user. The neck-worn hand sanitizer dispenser may be adapted to dispense a sanitizer liquid onto a hand of the user when the user triggers the dispensing mechanism by placing the hand beneath the sanitizer vessel. The dispensing mechanism may be disabled via a lock control to prevent dispensing the sanitizer liquid accidently.

An object of the invention is to dispense sanitizer liquid onto a hand of a user.

Another object of the invention is to wear the sanitizer vessel and dispensing mechanism in front of the chest of the user on a neck strap.

A further object of the invention is to trigger the dispensing mechanism when the hand is placed beneath the sanitizer vessel.

Yet another object of the invention is to provide a lock control to prevent unintentional dispensing of the sanitizer liquid.

These together with additional objects, features and advantages of the neck-worn hand sanitizer dispenser will be readily apparent to those of ordinary skill in the art upon reading the following detailed description of the presently preferred, but nonetheless illustrative, embodiments when taken in conjunction with the accompanying drawings.

In this respect, before explaining the current embodiments of the neck-worn hand sanitizer dispenser in detail, it is to be understood that the neck-worn hand sanitizer dispenser is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the neck-worn hand sanitizer dispenser.

It is therefore important that the claims be regarded as including such equivalent construction insofar as they do not depart from the spirit and scope of the neck-worn hand sanitizer dispenser. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
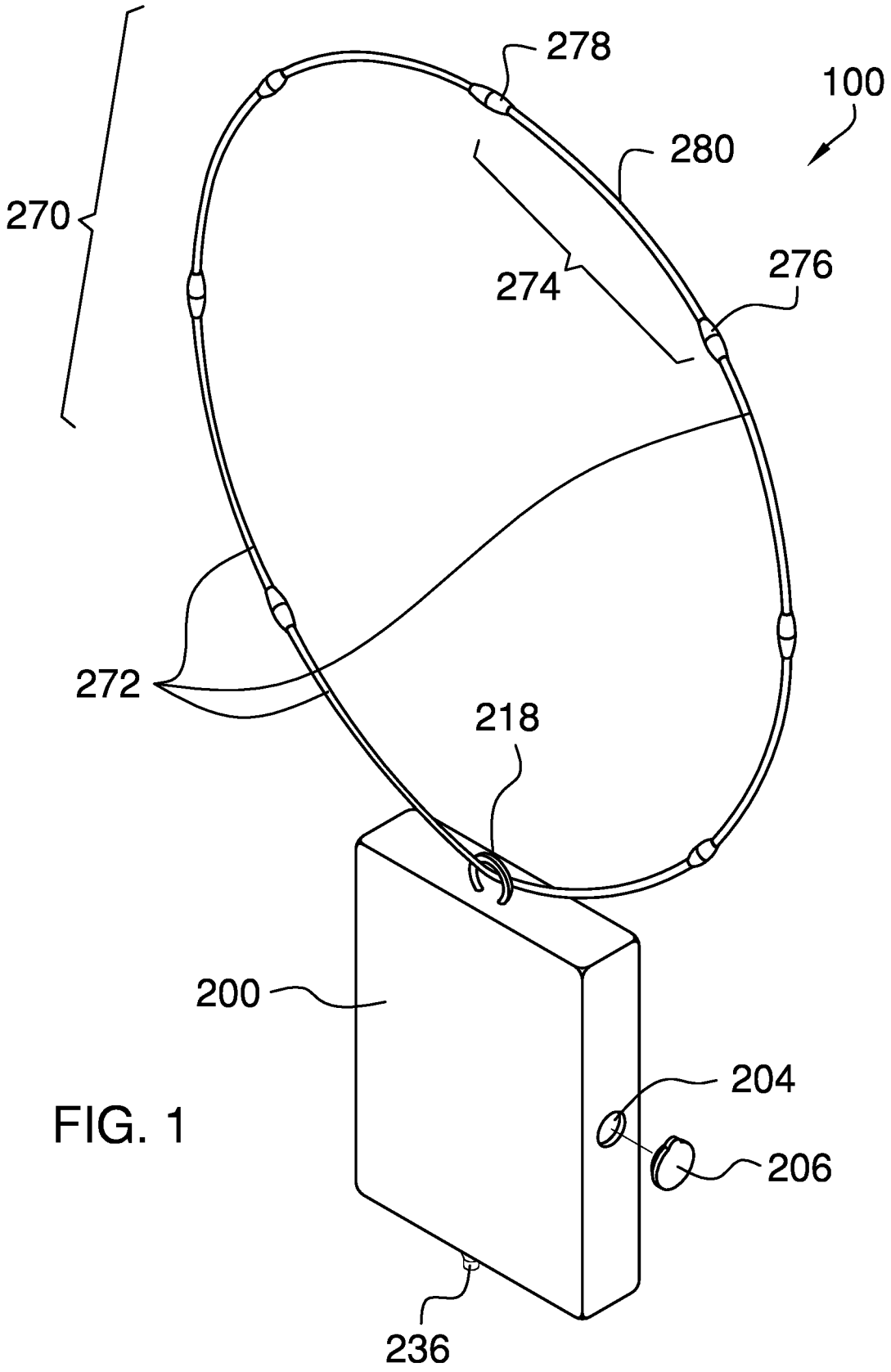
FIG. 1 is an isometric view of an embodiment of the disclosure.
Figure 2:
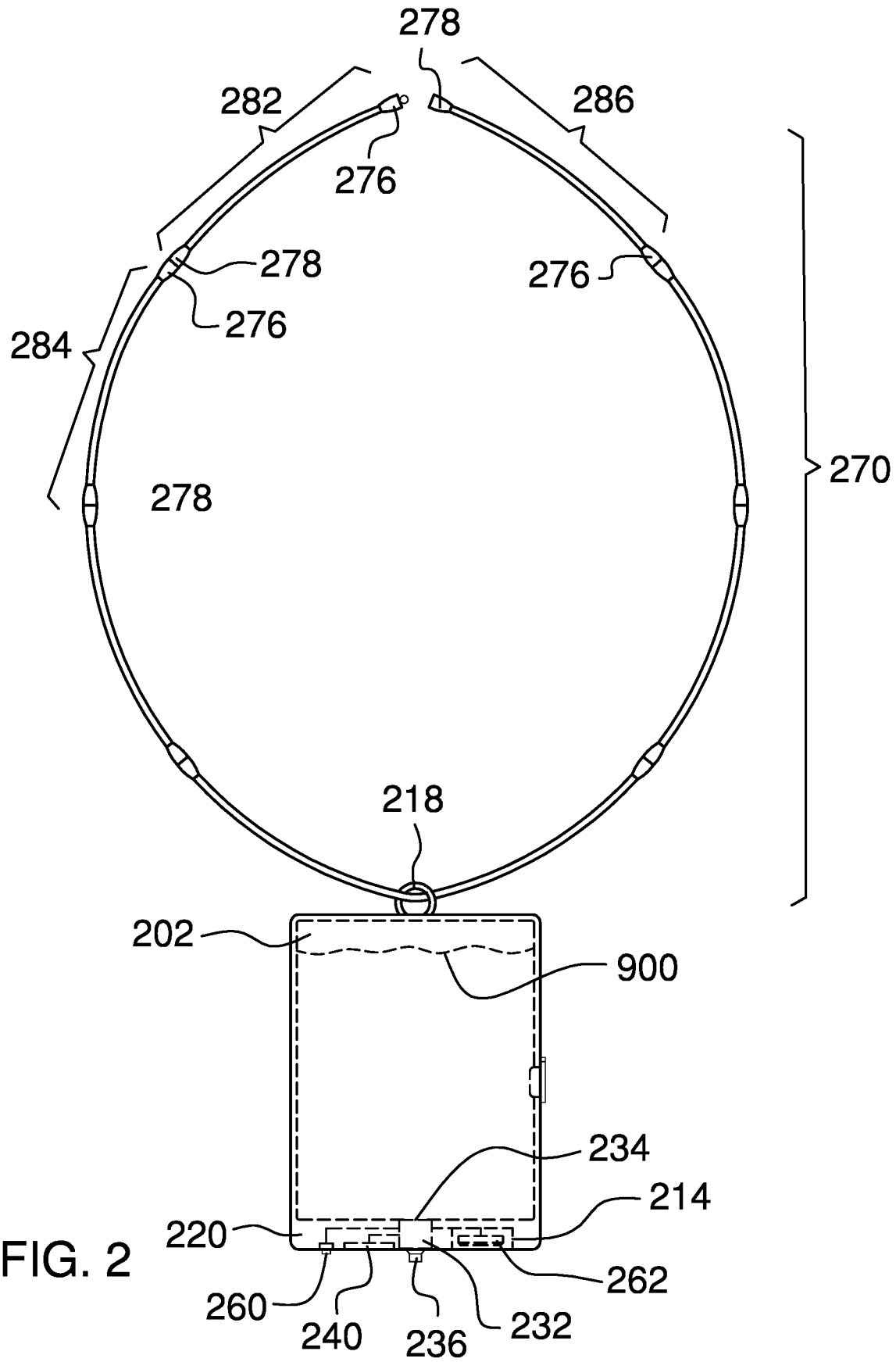
FIG. 2 is a front view of an embodiment of the disclosure.
Figure 3:
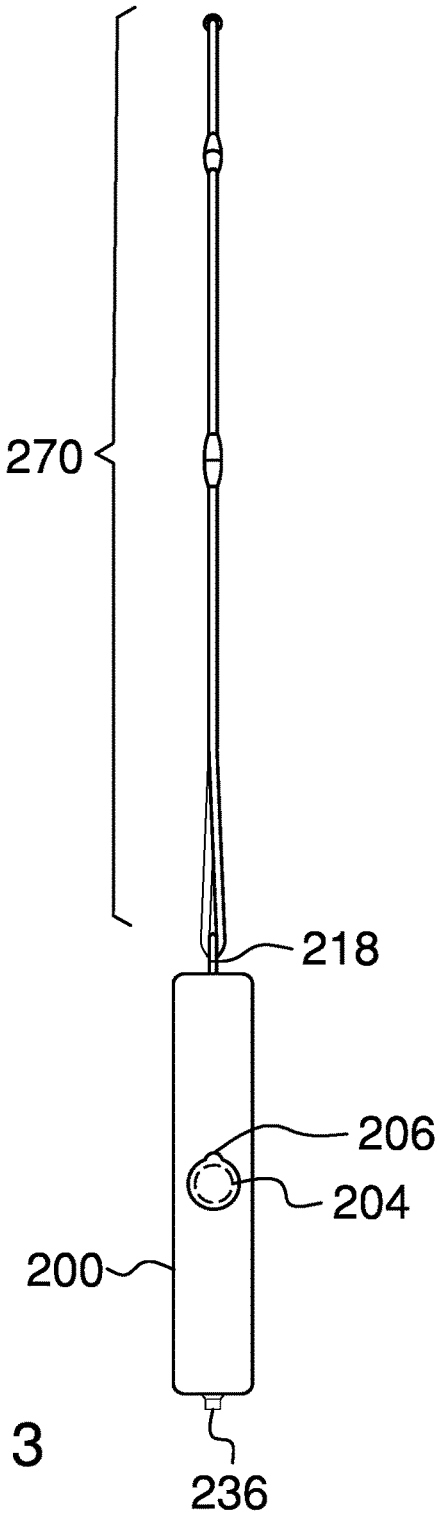
FIG. 3 is a side view of an embodiment of the disclosure.
Figure 4:
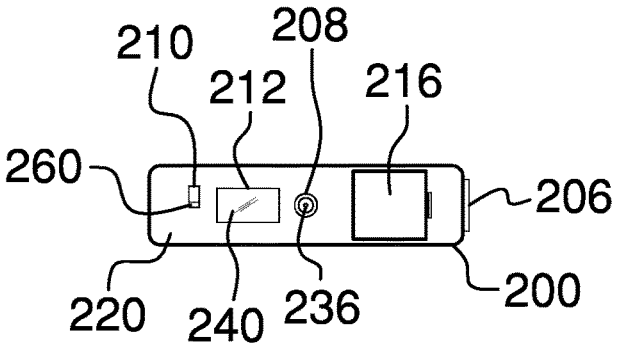
FIG. 4 is a bottom view of an embodiment of the disclosure.
Figure 5:
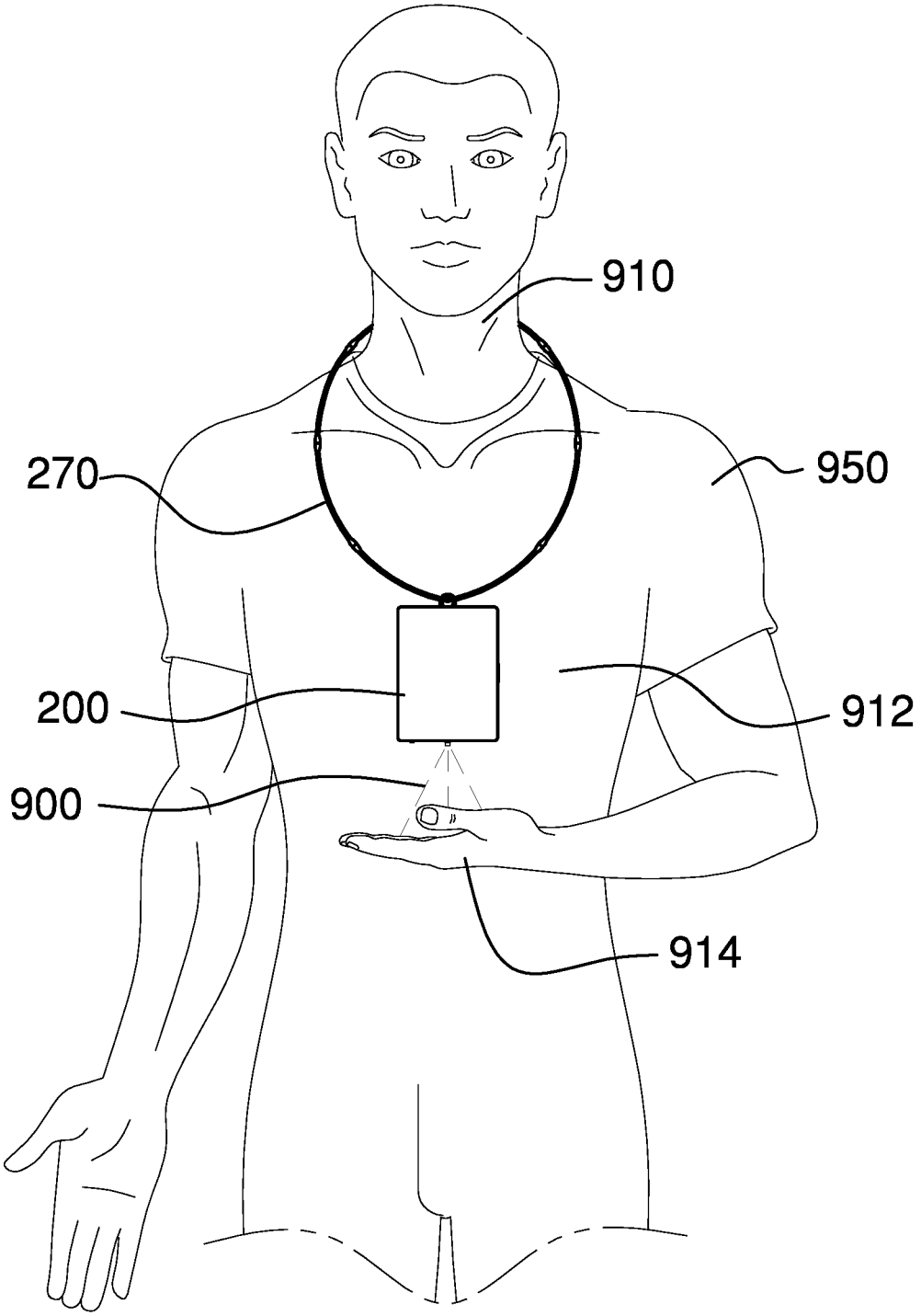
FIG. 5 is an in-use view of an embodiment of the disclosure.

Detailed reference will now be made to a first potential embodiment of the disclosure, which is illustrated in FIGS. 1 through 5.

The neck-worn hand sanitizer dispenser 100 (hereinafter invention) comprises a sanitizer vessel 200, a dispensing mechanism, and a neck strap 270. The invention 100 may be adapted to be worn around a neck 910 of a user 950 via the neck strap 270 such that the sanitizer vessel 200 hangs in front of a chest 912 of the user 950. The invention 100 may be adapted to dispense a sanitizer liquid 900 onto a hand 914 of the user 950 when the user 950 triggers the dispensing mechanism by placing the hand 914 beneath the sanitizer vessel 200. The dispensing mechanism may be disabled via a lock control 260 to prevent dispensing the sanitizer liquid 900 accidently.

The sanitizer vessel 200 may be a container for holding a supply of the sanitizer liquid 900 in a hollow interior 202 of the sanitizer vessel 200. The sanitizer vessel 200 may be refillable via a refill aperture 204. A refill cap 206 may cover the refill aperture 204 to prevent spilling of the sanitizer liquid 900 when not refilling. The sanitizer vessel 200 may comprise a battery compartment 214. The battery compartment 214 may hold a battery 262. The battery 262 may be accessible for replacement via a battery access door 216.

The sanitizer vessel 200 may comprise a neck strap coupler such that the neck strap 270 may be coupled to the sanitizer vessel 200. The sanitizer vessel 200 may be suspended from the neck 910 of the user 950 by the neck strap 270 such that the sanitizer vessel 200 is available to dispense the sanitizer liquid 900 when needed.

The dispensing mechanism may comprise a sensor 240, a pump 232, the lock control 260, and the battery 262. The dispensing mechanism may dispense the sanitizer liquid 900 when the user 950 places the hand 914 beneath the sanitizer vessel 200. The dispensing mechanism may be contained within a bottom wall 220 of the sanitizer vessel 200.

The sensor 240 may be located on the bottom wall 220 of the sanitizer vessel 200 adjacent to a nozzle 236. The sensor 240 may have visibility beneath the sanitizer vessel 200 via a sensor aperture 212 on the sanitizer vessel 200. The sensor 240 may be adapted to determine that the hand 914 is present beneath the sanitizer vessel 200 and to complete an electrical circuit if the hand 914 is present. Completion of the electrical circuit by the sensor 240 may energize the pump 232.

In some embodiments, the sensor 240 may be a motion sensor that responds to motion in front of the sensor 240. In some embodiments, the sensor 240 may be a proximity sensor that responds to objects within a predetermined distance of the sensor 240.

In some embodiments, the sensor 240 may be an optical sensor that detects changes in ambient or reflected light. In some embodiments, the optical sensor may be sensitive to light in the infrared (IR) spectrum. In some embodiments, the sensor may be an ultrasonic sensor that detects changes in reflected sound waves. In some embodiments, the sensor 240 may be an RF sensor and may detect changes in a reflected RF field. In some embodiments, the sensor 240 may be a capacitive sensor that detects changes in an electrostatic field. In some embodiments, the sensor 240 may be a thermal sensor that detects changes in temperature within a field of view of the sensor 240.

The pump 232 may force the sanitizer liquid 900 from a pump intake 234 to the nozzle 236 when the pump 232 is energized. The pump intake 234 may be located inside of the sanitizer vessel 200 and the sanitizer liquid 900 that is within the sanitizer vessel 200 may flow into the pump intake 234 when the sanitizer vessel 200 is hanging from the neck strap 270. The nozzle 236 may be exposed outside of the sanitizer vessel 200 via a dispensing aperture 208 located on the bottom wall 220 of the sanitizer vessel 200. The nozzle 236 may be adapted to spray the sanitizer liquid 900 that is dispensed onto the hand 914 of the user 950.

The lock control 260 may prevent accidental dispensing of the sanitizer liquid 900 when it is desirable to not dispense the sanitizer liquid 900. The lock control 260 may be adapted to enable and disable the pump 232 based upon a setting of the lock control 260 chosen by the user 950. The lock control 260 may enable the pump 232 by completing the electrical circuit to the pump 232 when the lock control 260 is in an UNLOCKED position. The lock control 260 may disable the pump 232 by interrupting the electrical circuit to the pump 232 when the lock control 260 is in a LOCKED position. The lock control 260 may be accessible outside of the sanitizer vessel 200 via a lock control aperture on the sanitizer vessel 200.

The battery 262 may comprise one or more energy-storage devices. The battery 262 may be a source of electrical energy to operate the pump 232 and the sensor 240. The battery 262 may be replaceable or rechargeable.

The neck strap 270 may be adapted to fit around the neck of the user 950 and to detachably couple to the sanitizer vessel 200 such that the sanitizer vessel 200 is carried in front of the chest 912 of the user 950. The neck strap 270 may comprise a plurality of strap segments 272 coupled end-to-end to form the neck strap 270.

An individual strap segment 274 selected from the plurality of strap segments 272 may comprise a first segment end and a second segment end 278 at opposite ends of a flexible tether 280. The first segment end 276 may detachably couple to the second segment end 278. Multiple neck segments may be joined by coupling the first segment end 276 of a first strap segment to the second segment end 278 of a second strap segment 284 to extend the length of the individual strap segments 274. The multiple neck segments may be passed through the neck strap coupler 218 and the first segment end 276 of the first strap segment 282 may be coupled to the second segment end 278 of a last strap segment 286 to complete a loop.

The couplings between the first segment end 276 and the second segment end 278 of the individual strap segments 274 may serve as a safety feature in that the neck strap 270 may break apart at one of these couplings if the neck strap 270 becomes caught and poses a risk of strangulation.

In use, the sanitizer vessel 200 may be filled with the sanitizer liquid 900 via the refill aperture 204 and the refill cap 206 may then be put in place to seal the sanitizer vessel 200. The sanitizer vessel 200 may be suspended from the neck 910 of the user 950 via the neck strap 270. If necessary, the neck strap 270 may be lengthened or shortened by adding or removing the individual strap segments 274. The lock control 260 may be moved to the UNLOCKED position to enable the dispensing mechanism. Whenever the hand 914 is placed beneath the nozzle 236, the sensor 240 may detect the hand 914 and energize the pump 232 which may dispense the sanitizer liquid 900 via the nozzle 236. The lock control 260 may be moved to the LOCKED position to prevent dispensing of the sanitizer liquid 900 if activity in front of the user 950 is anticipated and it is desirable to not dispense the sanitizer liquid 900 when the hands 914 pass beneath the sanitizer vessel 200.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface. Aperture may be synonymous with hole, slit, crack, gap, slot, or opening.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", may refer to connecting, either directly or indirectly, and does not necessarily imply a mechanical connection.

As used herein, "energize" and/or "energization" may refer to the application of an electrical potential to a system or subsystem.

As used herein, "filling", or "refilling", refers to the act of placing a first item into a second item whether the quantity of the first item fills the second item or not. As non-limiting examples, the first item may be a liquid, such as water or gasoline, or a granulated solid, such as sand or coffee beans. As non-limiting examples, the second item may be a bin, a bottle, a tank, or another type of container.

As used in this disclosure, "flexible" may refer to an object or material which will deform when a force is applied to it, which will not return to its original shape when the deforming force is removed, and which may not retain the deformed shape caused by the deforming force.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, the word "interior" may be used as a relational term that implies that an object is located or contained within the boundary of a structure or a space.

As used herein, "motion sensor" may refer to an electrical device that detects motion across the sensor's field of view. Motion sensors may be classified as active or passive based upon whether they emit a signal (active) or not (passive). The motion sensor may act as an electrical switch and may complete an electrical circuit in the presence of detected motion.

As used herein, "proximity sensor" may refer to an electrical device that is able to detect the presence of nearby objects without any physical contact. A proximity sensor may emit an electromagnetic field or a beam of electromagnetic radiation (infrared, for instance) and may look for changes in the field or return signal. The object being sensed may be referred to as the proximity sensor's target. Different technologies may be used in the proximity sensor based upon the composition of the intended target. As non-limiting examples, a capacitive proximity sensor or photoelectric sensor might be used to sense a plastic target and an inductive proximity sensor may be used to sense a metal target. The proximity sensor may act as an electrical switch and may complete an electrical circuit in the presence of the sensor's target.

As used in this disclosure, a "pump" may be a mechanical or electromechanical device that uses suction or pressure to raise or move fluids, compress fluids, or force a fluid into an inflatable object. As non-limiting examples, fluids may include both liquids, such as water, and gases, such as air.

As used herein, "RF" may refer to Radio Frequency. In general, an alternating electromagnetic field may be considered to be a radio frequency if the oscillation rate is between approximately 20 kHz and 300 GHz.

As used in this disclosure, a "sensor" may be a device that quantitatively measures a physical stimulus.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A neck-worn hand sanitizer dispenser comprising:

a sanitizer vessel, a dispensing mechanism, and a neck strap;

wherein the neck-worn hand sanitizer dispenser is adapted to be worn around a neck of a user via the neck strap such that the sanitizer vessel hangs in front of a chest of the user;

wherein the neck-worn hand sanitizer dispenser is adapted to dispense a sanitizer liquid onto a hand of the user when the user triggers the dispensing mechanism by placing the hand beneath the sanitizer vessel;

wherein the dispensing mechanism is disabled via a lock control to prevent dispensing the sanitizer liquid accidently;

wherein the sanitizer vessel is a container for holding a supply of the sanitizer liquid in a hollow interior of the sanitizer vessel;

wherein the sanitizer vessel is refillable via a refill aperture;

wherein a refill cap covers the refill aperture to prevent spilling of the sanitizer liquid when not refilling;

wherein the sanitizer vessel comprises a battery compartment;

wherein the battery compartment holds a battery;

wherein the battery is accessible for replacement via a battery access door;

wherein the sanitizer vessel comprises a neck strap coupler such that the neck strap is coupled to the sanitizer vessel;

wherein the sanitizer vessel is adapted to be suspended from the neck of the user by the neck strap such that the sanitizer vessel is available to dispense the sanitizer liquid when needed;

wherein the dispensing mechanism comprises a sensor, a pump, the lock control, and the battery;

wherein the dispensing mechanism is adapted to dispense the sanitizer liquid when the user places the hand beneath the sanitizer vessel;

wherein the dispensing mechanism is contained within a bottom wall of the sanitizer vessel;

wherein the sensor and a nozzle are located on the bottom wall of the sanitizer vessel;

wherein the sensor has visibility beneath the sanitizer vessel via a sensor aperture on the sanitizer vessel;

wherein the sensor is adapted to determine that the hand is present beneath the sanitizer vessel and to complete an electrical circuit if the hand is present;

wherein completion of the electrical circuit by the sensor energizes the pump.

2. The neck-worn hand sanitizer dispenser according to claim 1 wherein the sensor is a motion sensor that responds to motion in front of the sensor.

3. The neck-worn hand sanitizer dispenser according to claim 1 wherein the pump forces the sanitizer liquid from a pump intake to the nozzle when the pump is energized;

wherein the pump intake is located inside of the sanitizer vessel and the sanitizer liquid that is within the sanitizer vessel flows into the pump intake when the sanitizer vessel is hanging from the neck strap;

wherein the nozzle is exposed outside of the sanitizer vessel via a dispensing aperture located on the bottom wall of the sanitizer vessel;

wherein the nozzle is adapted to spray the sanitizer liquid that is dispensed onto the hand of the user.

4. The neck-worn hand sanitizer dispenser according to claim 3 wherein the lock control prevents accidental dispensing of the sanitizer liquid;

wherein the lock control is adapted to enable and disable the pump based upon a setting of the lock control chosen by the user;

wherein the lock control enables the pump by completing the electrical circuit to the pump when the lock control is in an UNLOCKED position;

wherein the lock control disables the pump by interrupting the electrical circuit to the pump when the lock control is in a LOCKED position;

wherein the lock control is accessible outside of the sanitizer vessel via a lock control aperture on the sanitizer vessel.

5. The neck-worn hand sanitizer dispenser according to claim 4 wherein the battery comprises one or more energy-storage devices;

wherein the battery is a source of electrical energy to operate the pump and the sensor;

wherein the battery is replaceable or rechargeable.

6. The neck-worn hand sanitizer dispenser according to claim 5 wherein the neck strap is adapted to fit around the neck of the user and to detachably couple to the sanitizer vessel such that the sanitizer vessel is carried in front of the chest of the user;

wherein the neck strap comprises a plurality of strap segments coupled end-to-end to form the neck strap.

7. The neck-worn hand sanitizer dispenser according to claim 6 wherein an individual strap segment selected from the plurality of strap segments comprises a first segment end and a second segment end at opposite ends of a flexible tether;

wherein the first segment end detachably couples to the second segment end;

wherein multiple neck segments are joined by coupling the first segment end of a first strap segment to the second segment end of a second strap segment to extend the length of the individual strap segments;

wherein the multiple neck segments are passed through the neck strap coupler;

wherein the first segment end of the first strap segment is coupled to the second segment end of a last strap segment to complete a loop.

8. The neck-worn hand sanitizer dispenser according to claim 7 wherein the couplings between the first segment end and the second segment end of the individual strap segments serve as a safety feature in that the neck strap breaks apart at one of these couplings if the neck strap becomes caught.

* * * * *